United States Patent [19]

Parkin

[11] 4,251,200

[45] Feb. 17, 1981

[54] APPARATUS FOR SPINNING BICOMPONENT FILAMENTS

[75] Inventor: Paul C. Parkin, Harrogate, England

[73] Assignee: Imperial Chemical Industries Limited, London, England

[21] Appl. No.: 97,067

[22] Filed: Nov. 23, 1979

[30] Foreign Application Priority Data

Nov. 30, 1978 [GB] United Kingdom ..... 46637/78

[51] Int. Cl.[3] ..... D01D 3/00; A21C 3/00

[52] U.S. Cl. ..... 425/131.5; 264/171; 264/DIG. 26; 425/133.1; 425/463; 428/373

[58] Field of Search ..... 264/171, DIG. 26; 425/131.5, 133.1, 463; 428/373

[56] References Cited

U.S. PATENT DOCUMENTS

| | | | |
|---|---|---|---|
| 2,989,798 | 6/1961 | Basnerman | 264/171 |
| 3,787,162 | 1/1974 | Cheetham | 264/171 |

FOREIGN PATENT DOCUMENTS

| | | | |
|---|---|---|---|
| 39-26141 | 11/1964 | Japan | 264/171 |
| 48-28366 | 8/1973 | Japan | 264/171 |
| 972932 | 10/1964 | United Kingdom | 264/171 |

*Primary Examiner*—Jay H. Woo

*Attorney, Agent, or Firm*—Roderick B. Macleod

[57] ABSTRACT

A spinning assembly for use in a process for the production of sheath/core bicomponent fibres comprising a spinneret plate having at least one counter-bore terminating in an extrusion orifice, a distributor plate spaced apart from but facing the spinneret plate to provide a liquid channel therebetween for communication with a source of sheath-forming material, the distributor plate being provided with an aperture opposite each orifice in the spinneret plate for communication with a source of core-forming material and a plateau-like protrusion on the distributor plate extending about the axis common to the aperture and the extrusion orifice characterised in that there is provided an orifice plate for restricting the entrance to the counter-bore.

2 Claims, 1 Drawing Figure

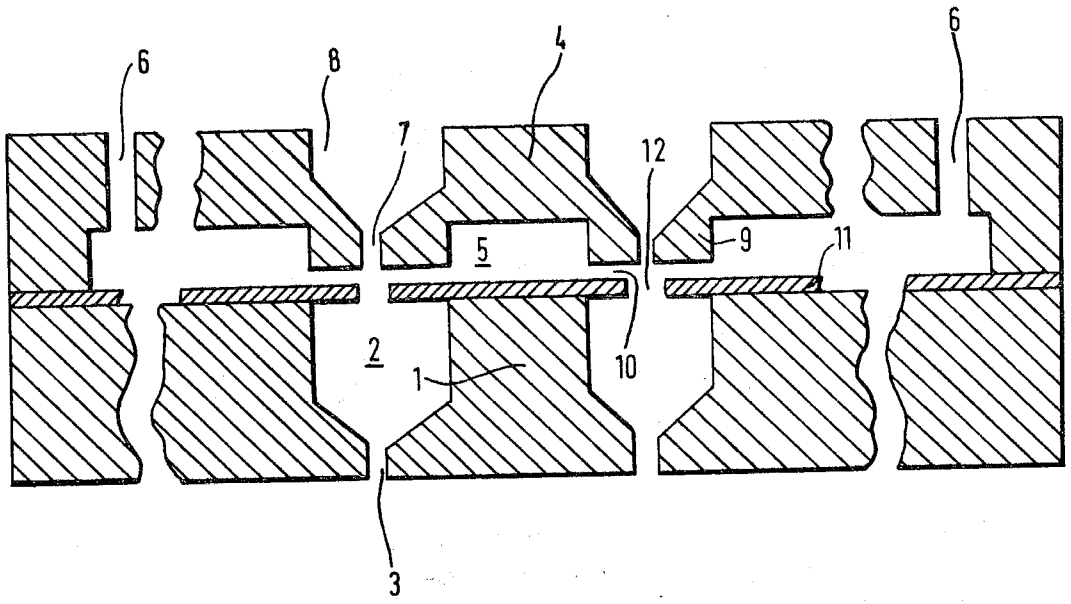
6
4
7
8
6
12
5
9
11
10
1
2
3

APPARATUS FOR SPINNING BICOMPONENT FILAMENTS

The present invention relates to an improved apparatus and process for spinning bicomponent filaments.

Bicomponent filaments of the sheath/core type are well known, and numerous spinning assemblies have been devised for their production. Many of these spinning assemblies use the basic concept of feeding the sheath-forming material to the spinneret orifices in a direction essentially perpendicular to the orifices, and injecting the core-forming material into the sheath forming material as it flows into the spinneret orifices, or the counter bore leading to the spinneret orifices, from orifices located in-line with the spinneret orifices. Such spinning assemblies are not entirely satisfactory in that the flow of the sheath-forming material is not uniform over the spinneret, and the sheath/core ratio of the filaments can vary widely across the spinneret. In some instances it is possible for some of the filaments to be formed from only one material, ie they are homofilaments rather than bicomponent filaments.

British Pat. No. 830,441 describes a way of reducing the possibility of forming homofilaments by the use of a spinning assembly comprising a front and a back plate spaced apart from but faced to each other so as to provide a liquid channel there between. The front plate is provided with an extrusion orifice therethrough, and at least one of the plates, on its side facing the other plate, is provided with a plateau-like protrusion so as to constrict the liquid channel in a region surrounding the extrusion orifice entrance and thus cause streams of the sheath forming material to converge substantially radially towards the orifice entrance. The dimensions of the components of the spinning assembly are so arranged that the pressure drop over the plateau is considerably greater than the pressure drop through the liquid channel, and, though rarely achievable in practice, is preferably at least approximately equal to, and desirably greater than, the pressure drop through the extrusion orifice. Because of the high pressure drop over the plateau relative to the pressure drop through the liquid channel, the sheath-forming material is fed to the extrusion orifices in an essentially uniform manner throughout the spinning assembly.

The above described bicomponent fibre spinning assembly functions quite satisfactorily, but suffers from the disadvantage that, under set conditions, the number of extrusion orifices per spinneret is limited, and that if the spacing between extrusion orifices is decreased in order to increase the number of orifices, and hence productivity, the effectiveness of the spinning assembly, at least as far as uniformity of fibres is concerned, is reduced. This limitation on the number of extrusion orifices arises from two factors, namely the dimensions of the plateaux, and the dimensions between the plateaux.

Firstly, the dimensions of the plateaux must be chosen so that the constrictions of the liquid channel in a region surrounding the extrusion orifice entrance give a sufficient pressure drop. The pressure drop can be achieved by using plateaux having a relatively large surface area and a large gap width between the plateaux and the face of the opposing plate, or, alternatively, plateaux of smaller surface area and a narrower gap. The latter arrangement is not really practicable because of the engineering problem of machining the components of the spinning assembly to give substantially uniform gaps throughout the spinning assembly, and therefore assemblies have been made using plateaux of relatively large dimensions. Secondly, the dimensions between the plateaux must be such that the sheath-forming material flows freely and uniformly to each and every constricted region surrounding an extrusion orifice.

Whilst the dimensions between the plateaux can not be reduced below that necessary to allow free and uniform flow of sheath-forming material, it has now been found possible to reduce the surface area of each plateau without reducing the dimensions of the gap formed between the plateau and the face of the opposing plate. The improved spinneret assembly is therefore able to accommodate more extrusion orifices per unit area than previous assemblies, and therefore has a higher throughput of material and greater efficiency.

According to the present invention there is provided a spinning assembly for the production of sheath/core bicomponent fibres, comprising a spinneret plate having at least one counter-bore terminating in an extrusion orifice, a distributor plate spaced apart from but facing the spinneret plate to provide a liquid channel therebetween for communication with a source of sheath-forming material, the distributor plate being provided with an aperture opposite each orifice in the spinneret plate and which communicates with a source of core-forming material, and a plateau-like protrusion extending about the axis common to the aperture of the distributor plate and the extrusion orifice of the spinneret plate to constrict the liquid channel in a region surrounding the entrance to the counter-bore of the extrusion orifice, characterised in that there is provided a means of restricting the entrance to the counter-bore.

We also provide a process for the production of sheath/core bicomponent fibres using a spinning assembly comprising a spinneret plate having at least one counter-bore terminating in an extrusion orifice, a distributor plate spaced apart from but facing the spinneret plate to provide a liquid channel therebetween, the distributor plate being provided with an aperture opposite each orifice in the spinneret plate, and a plateau-like protrusion extending about the axis common to the aperture of the distributor plate and the extrusion orifice of the spinneret plate to constrict the liquid channel in a region surrounding the entrance to the counter-bore of the extrusion orifice, in which core forming material flows into the apertures provided in the distributor plate and sheath forming material flows into the liquid channel between the distributor plate and the spinneret plate, characterised in that the flow of the sheath forming material into the entrance to the counter-bore of the extrusion orifice is restricted by a restricting means provided in the spinning assembly.

Conveniently the means of restricting the entrance to the counter-bore of the extrusion orifice is an orifice plate located on the surface of the spinneret plate facing the distributor plate, the orifice plate having an orifice which has an axis common with that of the aperture of the distributor plate and of the extrusion orifice of the spinneret plate. In order to restrict the entrance of the counter-bore, the dimensions of the orifice of the orifice plate are less than the dimensions of the counter-bore.

The plateau-like protrusion may be formed on the surface of the orifice plate, but is more conveniently formed on the surface of the distributor plate. Preferably the plateau-like protrusion is in the form of a cylinder extending from the plate, and desirably the diameter of the cylinder is approximately twice the diameter of the orifice in the orifice plate.

The actual dimensions of the various components of the spinning assembly will depend upon the properties of the materials to be spun and the actual conditions of spinning, and can be readily determined by the skilled person.

The invention is illustrated with reference to the accompanying drawing which is an axial longitudinal section through a spinning assembly according to the invention.

Referring to the drawing, a spinning assembly for the production of sheath/core bicomponent filaments comprises a spinneret plate 1 having a number of counter-bores 2, each counter-bore terminating in an extrusion orifice 3, and a distributor plate 4 spaced apart from but face to the spinneret plate to provide a liquid channel 5. The liquid channel communicates with a source of sheath-forming material (not shown) by means of bores 6. The distributor plate has a number, equal to the number of counter-bores 2, of apertures 7 the axis of each aperture being in-line with the axis of an extrusion orifice 3. Each aperture communicates by means of counter-bores 8 with a source of core-forming material (not shown). A cylindrical plateau-like protrusion 9 extends from the distributor plate about the axis common to an aperture of the distributor plate and its associated extrusion orifice of the spinneret plate to form a constriction 10 in the liquid channel in a region surrounding the entrance to each counter-bore of an extrusion orifice. Located on the upper surface of the spinneret plate is an orifice plate 11 having a series of orifices 12, the axis of an orifice being common with that of the aperture of the distributor plate and of the extrusion orifice of the spinneret plate. The diameter of the orifices in the orifice plate is substantially less than that of the counter-bore 2 of the spinneret plate and of the cylindrical protrusion 9. The spinneret plate, orifice plate and distributor plate are clamped together and to the sources of sheath-and-core-forming material by means not shown.

In use, sheath-forming material from a source not shown flows through bores 6 into a relatively unconstricted feed channel 5 and towards each cylindrical protrusion 9. The material then flows through the constriction 10 radially to the orifice 12 and thence into the counter-bore of the spinneret plate. Simultaneously, core-forming material from a source not shown flows via counter-bores 8 and apertures 7 of the distributor plate 4, and orifice 12 of the orifice plate into the counter-bore 2. Thus, the two materials are present in the counter-bore 2 in a sheath/core relationship, and are extruded therefrom through the extrusion orifice 3 in the same relationship.

The spinning assembly was used to produce a sheath-/core bicomponent fibre, the sheath being formed from a polyethylene terephthalate-isophthalate copolymer (ratio 85:15) having an intrinsic viscosity of 0.58 dl per g measured in O-chlorophenol at 25° C., and the core being formed from polyethylene terephthalate having an intrinsic viscosity of 0.675. The spinning assembly was circular, had a diameter of 7 inches and 600 extrusion orifices, and was adapted to accommodate an outflow quench unit. Dimensions of the various components were as follows:

| | |
|---|---|
| Diameter of cylindrical protrusions | 1.35 to 1.60 mm |
| Depth of cylindrical protrusions | 2.0 mm |

-continued

| | |
|---|---|
| Diameter of aperture of distribution plate | 0.5 mm |
| Diameter of counter-bore of distribution plate | 1.5 mm |
| Distance between cylindrical protrusions | 1.8 mm |
| Width of constriction (10) at plateau | 0.125 mm |
| Diameter of orifice in orifice plate | 0.75 mm |
| Diameter of counter-bore of spinneret plate | 1.5 mm |
| Diameter of extrusion orifice | 0.38 mm |
| Extrusion orifice spacing - along rows | 3.4 mm |
| - between rows | 3.4 to 4.0 mm |

Sheath/core bicomponent filaments of 9.3 decitex were spun using a wind-up speed of 854 meters per minute to be drawn at a later stage to give drawn fibres of 3.3 decitex. The spinning throughput was 30.3 kg per hour. When the wind-up speed was raised to 1500 meters per minute, the throughput was increased to 40.0 kg per hour.

The ratio of core to sheath-forming material could be increased to a value of at least 75:25 without the production of homofilaments formed entirely from the core-forming material.

The spinning assembly was afterwards fitted with conventional distributor and spinneret plates of the type described in British Pat. No. 830,441 and without an orifice plate. Dimensions of the various components were as follows:

| | |
|---|---|
| Diameter of cylindrical protrusions | 2.75 to 3.00 mm |
| Depth of cylindrical protrusions | 1.8 mm |
| Diameter of aperture of distribution plate | 0.38 mm |
| Diameter of counter-bore of distribution plate | 1.5 mm |
| Distance between cylindrical protrusions | 1.8 mm |
| Width of constriction at plateau | 0.125 mm |
| Diameter of counter-bore of spinneret plate | 1.5 mm |
| Diameter of extrusion orifice | 0.38 mm |
| Extrusion orifice spacing | |
| - along rows | 5.0 mm |
| - between rows | 5.6 mm |

It was only possible to produce an assembly having 378 extrusion orifices, which, when used under idential conditions as above, had a throughput of only 19.1 and 24.8. kg per hour at wind-up speeds of 854 and 1500 meters per minute, respectively. The ratio of core to sheath-forming material could be raised to a value of 75:25, but at a ratio of 80:20 some homofilaments of core-forming material were produced.

An attempt was made to increase the throughput of the above described conventional spinning assembly by reducing the diameter of the castellations. Relevant dimensions were:

| | |
|---|---|
| Diameter of castellations | 2.50 to 2.75 mm |
| Extrusion orifice spacing | |
| along rows | 4.75 mm |
| between rows | 4.5 mm |

Throughput was increased to 22.8 and 30.3 kg per hour at wind-up speeds of 854 and 1500 meters per minute, but it was only possible to produce satisfactorily filaments having a core to sheath ratio up to 70:30. At a ratio of 75:25 some of the filaments were formed entirely of the core material.

The described spinning assembly is suitable for spinning a wide variety of sheath/core combinations including various combinations of polyethylene terephthalate, polyethylene terephthalate-polyethylene isophthalate, copolymers, polyamides and polyolefines.

I claim:

1. A spinning assembly for the production of sheath-/core bicomponent fibres, comprising a spinneret plate having at least one counter-bore terminating in an extrusion orifice, a distributor plate spaced apart from but facing the spinneret plate to provide a liquid channel there-between for communication with a source of sheath-forming material, the distributor plate being provided with an aperture opposite each orifice in the spinneret plate and which communicates with a source of core-forming material, and a plateau-like protrusion extending about the axis common to the aperture of the distributor plate and the extrusion orifice of the spinneret plate to constrict the liquid channel in a region surrounding the entrance to the counter-bore of the extrusion orifice the improvement being that there is provided a means of restricting the entrance to the counter-bore.

2. A spinning assembly as claimed in claim 1 in which the means of restricting the entrance to the counter-bore of the extrusion orifice is an orifice plate, the orifice plate having an orifice which has an axis common with that of the aperture of the distributor plate and of the extrusion orifice of the spinneret plate.

* * * * *